US011742128B2

(12) United States Patent
Radu et al.

(10) Patent No.: US 11,742,128 B2
(45) Date of Patent: Aug. 29, 2023

(54) TRANSFORMERS

(71) Applicant: HITACHI ENERGY SWITZERLAND AG, Baden (CH)

(72) Inventors: Ion C. Radu, Raleigh, NC (US); George K. Frimpong, Raleigh, NC (US)

(73) Assignee: HITACHI ENERGY SWITZERLAND AG, Baden (CH)

( * ) Notice: Subject to any disclaimer, the term of this patent is extended or adjusted under 35 U.S.C. 154(b) by 691 days.

(21) Appl. No.: 16/584,277

(22) Filed: Sep. 26, 2019

(65) Prior Publication Data

US 2021/0098172 A1 Apr. 1, 2021

(51) Int. Cl.
*H01F 27/26* (2006.01)
*H01F 27/02* (2006.01)
(Continued)

(52) U.S. Cl.
CPC ..... *H01F 27/025* (2013.01); *H01F 3/00* (2013.01); *H01F 27/06* (2013.01); *H01F 27/14* (2013.01); *H01F 27/26* (2013.01); *H01F 27/263* (2013.01)

(58) Field of Classification Search
CPC ..... H01F 27/025; H01F 3/00; H01F 27/06; H01F 27/14; H01F 27/26; H01F 27/263;
(Continued)

(56) References Cited

U.S. PATENT DOCUMENTS 2,910,663 A * 10/1959 Wilk ..... H01F 27/263 336/60
3,110,873 A 11/1963 Mittermaier
(Continued)

FOREIGN PATENT DOCUMENTS

CN 201156464 Y 11/2008
CN 108109811 A 6/2018
(Continued)

OTHER PUBLICATIONS

Dasara Sujana et al: "Shielding measures of power transformer to mitigate stray loss and hot spot trough coupled 3D FEA", High Voltage, The Institution of Engineering and Technology, Michael Faraday House, Six Hills Way, Stevenage, Herts. SG1 2AY, UK, vol. 2, No. 4, Dec. 1, 2017, pp. 267-273, XP006064592, ISSN: 2397-7264.

(Continued)

*Primary Examiner* — Tuyen T Nguyen
(74) *Attorney, Agent, or Firm* — Sage Patent Group

(57) ABSTRACT

A transformer having a transformer core that forms a magnetic flux path between and through a top yoke, leg, and bottom yoke of the transformer core. A winding can be disposed about the leg. Further, a flitch plate, which can have at least one slot that is configured to reduce eddy losses generated by the winding, can be disposed adjacent to the leg and extend between the top yoke and the bottom yoke.
(Continued)

The flitch plate can be clamped to the top and bottom yokes by top and bottom clamps, respectively. The top and bottom clamps can each include at least one cutout that reduces an attraction of stray flux from the winding and into the corresponding top and bottom clamps. Additionally, at least one of the top clamp and the bottom clamp can include an internal lattice structure.

19 Claims, 11 Drawing Sheets

(51) Int. Cl.
*H01F 3/00* (2006.01)
*H01F 27/06* (2006.01)
*H01F 27/14* (2006.01)

(58) Field of Classification Search
CPC ..... H01F 27/08; H01F 27/34; H01F 27/24; H01F 27/266; H01F 27/306; H01F 2027/348
See application file for complete search history.

(56) References Cited

U.S. PATENT DOCUMENTS

| | | | |
|---|---|---|---|
| 3,349,357 | A | 10/1967 | McNutt et al. |
| 4,521,954 | A | 6/1985 | Rademaker et al. |
| 4,839,622 | A | 6/1989 | Hay |
| 4,890,086 | A | 12/1989 | Hill |
| 6,806,803 | B2 | 10/2004 | Hopkinson et al. |
| 2012/0212312 | A1 | 8/2012 | Johnson et al. |

FOREIGN PATENT DOCUMENTS

| | | | | |
|---|---|---|---|---|
| GB | 1102155 | A | | 2/1968 |
| JP | 57004109 | A | | 1/1982 |
| JP | 2007067109 | A | * | 3/2007 |
| JP | 2008182053 | A | | 8/2008 |
| KR | 20160052214 | A | | 5/2016 |

OTHER PUBLICATIONS

Ugale R et al: "Analytical and FEM design of autotransformer with phase shifting capability by Intermediate Vorltage variation", 2016 XXII International Conference on Electrical Machines (ICEM), IEEE, Sep. 4, 2016, pp. 1345-1351, XP032989523.

* cited by examiner

| Number of slots | Flitch Plate Max. Temp. rise | Top Oil Temp. | Temp. ambient | Flitch Plate Max. Temp. |
|---|---|---|---|---|
| | ºC | ºC | ºC | ºC |
| 0 | 59.3 | 55 | 30 | 144.3 |
| 1 | 29.7 | 55 | 30 | 114.7 |
| 2 | 19.8 | 55 | 30 | 104.3 |
| 3 | 14.8 | 55 | 30 | 99.8 |
| 4 | 11.9 | 55 | 30 | 96.9 |

CALCULATED FLITCH PLATE TEMPERATURE RISE VS NUMBER OF SLOTS IN A THREE-PHASE 432 MVA, 230+3-1x2.5%/18 kV TRANSFORMER

FIG. 4

| Transformer Core TYPE | Maximum temperature rise over the oil | | Traditional clamps | New core clamps (cut outs, solid body) |
|---|---|---|---|---|
| EY Core | Bottom core clamps | ºC | 112 | 64.2 |
| | Top core clamps | ºC | 66.9 | 48.6 |
| D Core | Bottom core clamps | ºC | 55.4 | 31.2 |
| | Top core clamps | ºC | 33.6 | 17.0 |
| DY Core | Bottom core clamps | ºC | 65 | 45.9 |
| | Top core clamps | ºC | 39.4 | 25.7 |
| T Core | Bottom core clamps | ºC | 90.6 | 54.5 |
| | Top core clamps | ºC | 54 | 48.4 |
| TY Core | Bottom core clamps | ºC | 38 | 21.5 |
| | Top core clamps | ºC | 12.8 | 9.5 |

FIG. 14

TRANSFORMERS

FIELD OF INVENTION

The present application relates generally to transformers, and more particularly, to core clamping structures for transformers.

BACKGROUND

Electrical systems and devices, such as transformers, remain an area of interest. Some existing systems have various shortcomings, drawbacks and disadvantages relative to certain applications. For example, transformer include clamping systems that can experience relatively high temperatures during operation that can damage the transformer and/or shorten the life span of the transformer. Additionally, at least certain types of transformers seek to prevent instances in which at least certain operating temperatures exceed temperature limits by increasing the size of at least certain transformer components, the size of the transformer tank, and the quantity of cooling medium, such as, for example, oil, in the transformer tank. Yet, such efforts can increase the size and weight, and thus the cost, of the transformer and associated system. Accordingly, there remains a need for further contributions in this area of technology.

BRIEF SUMMARY

Embodiments of the present invention includes a unique transformer. Other embodiments include core clamps, flitch plates, apparatuses, systems, devices, hardware, methods, and combinations for transformers. Further embodiments, forms, features, aspects, benefits, and advantages of the present application shall become apparent from the description and figures provided herewith.

An aspect of an embodiment of the present application is a transformer having a transformer core that can include a top yoke, a bottom yoke, and a leg. The leg can extend between the top yoke and the bottom yoke. Further, the transformer core can be constructed to form a magnetic flux path between and through the top yoke, the leg, and the bottom yoke. The transformer can also include a winding that is disposed about the leg and a flitch plate that can be disposed adjacent to the leg, and which can extend between the top yoke and the bottom yoke. The transformer can further include a core clamp having a top clamp and a bottom clamp. The flitch plate can be clamped to the top yoke by the top clamp and clamped to the bottom yoke by the bottom clamp. Further, the top clamp and the bottom clamp can each include a cutout that is positioned and sized to reduce an attraction of stray flux from the winding into the corresponding top clamp and bottom clamp.

Another aspect of an embodiment of the present application is a transformer having a transformer core that can include a top yoke, a bottom yoke, and a leg. The leg can extend between the top yoke and the bottom yoke. Further, the transformer core can be constructed to form a magnetic flux path between and through the top yoke, the leg, and the bottom yoke. The transformer can also include a winding that is disposed about the leg, and a flitch plate that can be disposed adjacent to the leg, and which can extend between the top yoke and the bottom yoke. Additionally, the flitch plate can have at least one slot that extends through the flitch plate, and which is positioned along at least a portion of the flitch plate between the top yoke and the bottom yoke. The at least one slot can be configured to at least assist in reducing eddy losses generated by the winding. The transformer can further include a core clamp having a top clamp and a bottom clamp. The flitch plate can be clamped to the top yoke by the top clamp and clamped to the bottom yoke by the bottom clamp.

Additionally, an aspect of an embodiment of the present application is a transformer having a transformer core that can include a top yoke, a bottom yoke, and a leg. The leg can extend between the top yoke and the bottom yoke. Further, the transformer core can be constructed to form a magnetic flux path between and through the top yoke, the leg, and the bottom yoke. The transformer can also include a winding that is disposed about the leg, and a flitch plate that can be disposed adjacent to the leg, and which can extend between the top yoke and the bottom yoke. Additionally, the flitch plate can have at least one slot that extends through the flitch plate, and which is positioned along at least a portion of the flitch plate between the top yoke and the bottom yoke. The at least one slot can be configured to at least assist in reducing eddy losses generated by the winding. The transformer can further include a core clamp having a top clamp and a bottom clamp, the flitch plate can be clamped to the top yoke by the top clamp and clamped to the bottom yoke by the bottom clamp. Further, the top clamp and the bottom clamp can each include a cutout that is positioned and sized to reduce an attraction of stray flux from the winding into the corresponding top clamp and bottom clamp. Additionally, at least one of the top clamp and the bottom clamp can include an internal lattice structure.

These and other aspects of the present invention will be better understood in view of the drawings and following detailed description.

BRIEF DESCRIPTION OF THE DRAWINGS

The description herein makes reference to the accompanying drawings wherein like reference numerals refer to like parts throughout the several views, and wherein:

FIG. 4 is a table illustrating non-limiting examples of calculated flitch plate temperature rise versus number of slots for main leg flitch plates, including temperature rise for some embodiments of the present invention.

FIG. 14 is a table illustrating non-limiting examples of calculated core clamp temperature rise for some embodiments of the present invention vs. calculated core clamp temperature rise for some corresponding traditional core clamps.

Figure 1:
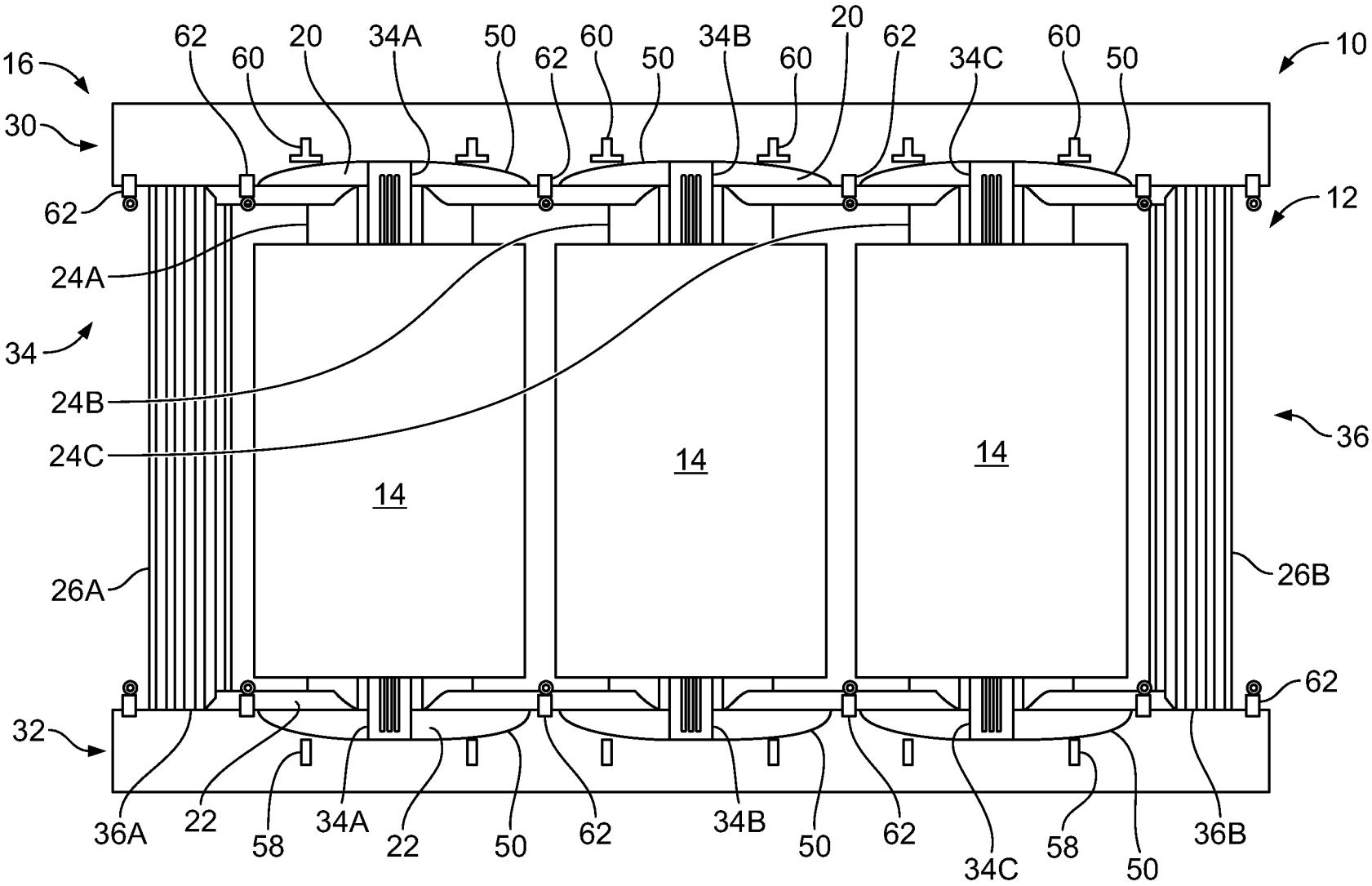
FIG. 1 schematically illustrates some aspects of a non-limiting example of a "TY core" transformer in accordance with an embodiment of the present invention.

The foregoing summary, as well as the following detailed description of certain embodiments of the present application, will be better understood when read in conjunction with the appended drawings. For the purpose of illustrating the application, there is shown in the drawings, certain embodiments. It should be understood, however, that the present application is not limited to the arrangements and instrumentalities shown in the attached drawings. Further, like numbers in the respective figures indicate like or comparable parts.

DESCRIPTION OF THE ILLUSTRATED EMBODIMENTS

Certain terminology is used in the foregoing description for convenience and is not intended to be limiting. Words such as "upper," "lower," "top," "bottom," "first," and "second" designate directions in the drawings to which reference is made. This terminology includes the words specifically noted above, derivatives thereof, and words of similar import. Additionally, the words "a" and "one" are defined as including one or more of the referenced item unless specifically noted. The phrase "at least one of" followed by a list of two or more items, such as "A, B or C," means any individual one of A, B or C, as well as any combination thereof.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Figure 2:
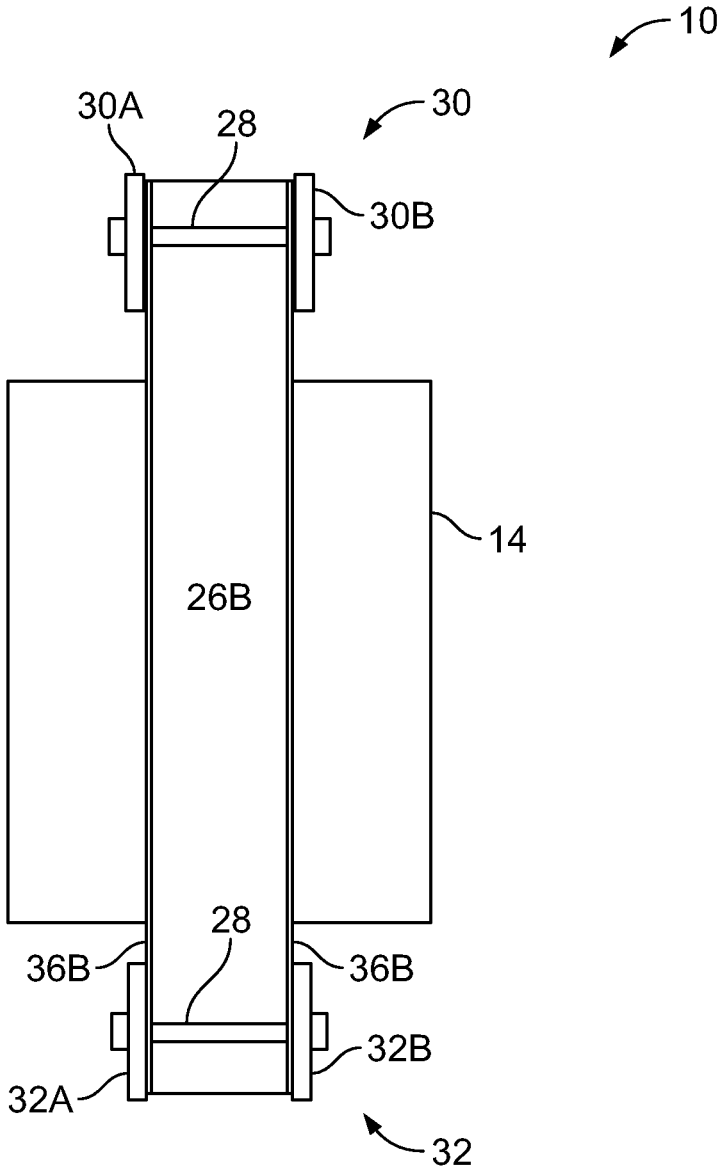
FIG. 2 schematically illustrates a right side view of some aspects of the non-limiting example of the transformer of FIG. 1.

Referring now to the drawings, and in particular FIGS. 1 and 2, some aspects of a non-limiting example of a transformer 10 are illustrated in accordance with an embodiment of the present invention. The embodiment of the transformer 10 depicted in FIGS. 1 and 2 is a three-phase "TY core" transformer. However, the transformer 10 can take other forms. Additionally, the transformer 10 can be any single-phase transformer or a multi-phase transformer, such as, for example, a three-phase transformer. Additionally, the transformer 10 can be a single or three-phase low voltage, medium voltage, or high voltage transformer, including transformers characterized as category I through category IV transformers under IEEE Standard C57.12.00-2015.

The transformer 10 can include a transformer core 12, one or more windings 14, and a core clamp 16. The transformer core 12 can include, in various embodiments, a top yoke 20 and a bottom yoke 22. Additionally, the transformer core 12 can include one or more main limbs or main legs 24, e.g., main legs 24A-C (collectively legs 24), that can extend between the top yoke 20 and the bottom yoke 22. Additionally, according to certain embodiments, the transformer core 12 can also include one or more side limbs or side legs 26, e.g., side legs 26A-B (collectively legs 26), that can also extend between the top yoke 20 and the bottom yoke 22. The number of main legs 24 and side legs 26 can vary with the needs of the application.

The transformer core 12 can be constructed to form a magnetic flux path, such as, for example, a low reluctance path, between, and through, its various components. For example, in the embodiment depicted in FIGS. 1 and 2, the transformer core 12 is constructed to form a magnetic flux path between, and through, the top and bottom yokes 20, 22, main legs 24, and, in at least some embodiments, the side legs 26. However, the transformer core 12 can have a variety of other configurations and/or components that can thus result in the formation of different flux paths. Such variations can include, but is not limited to, the number of main and side legs 24, 26, and the material(s) used to construct the transformer core 12. For example, while FIG. 1 depicts a three phase transformer core 12 having three main legs 24 and two side legs 26, and which can be made of electrical steel that can provide a relatively low reluctance magnetic flux path, a different number of main legs 24, side legs 26, and/or a different transformer core 12 material can, in at least certain situations, alter the flux path.

As shown in at least FIG. 1, according to the illustrated embodiment, windings 14 can be disposed about the main legs 24A-C, while such windings 14 may, or may not, be disposed about the side legs 26A-B. Further, according to certain embodiments, the windings 14 that are disposed about the main legs 24A-C can include a plurality of windings, such as, for example, high, medium and/or low voltage windings that can be grouped together, and/or may include tap windings or other winding types disposed about each main leg 24A-C. In other embodiments, the windings 14 disposed about any particular main leg 24A-C can composed of different windings e.g., a high, medium and/or low voltage winding, or a tap winding, among other types of windings.

The core clamp 16 can include a top clamp 30, a bottom clamp 32, and a plurality of tie plates or flitch plates 34, 36, such as, for example, main leg flitch plates 34A-C (collectively main flitch plates 34) and side leg flitch plates 36A-B (collectively side leg flitch plates 36). The flitch plates 34, 36 can be fixed or secured to each of the top clamp 30 and the bottom clamp 32 of the core clamp 16 in variety of manners, including, for example, via pins, fasteners, clips and/or other retaining and/or fastening features. Additionally, the flitch plates 34, 36 can be constructed to transmit mechanical loads between at least the top yoke 20 and the bottom yoke 22. Moreover, mechanical loads, e.g., tensile loads, can be transmitted between the top and bottom yokes 20, 22 by the flitch plates 34, 36. The flitch plates 34, 36 can also be configured to support the weight of the transformer 10 at least when the transformer 10 is introduced into a transformer tank, when the transformer 10 is moved, and against relatively high axial and radial forces that can be generated at least by high current that may be present in the windings 14 in connection with a short circuit in the power grid.

The number of main and side leg flitch plates 34, 36 can vary with the needs of the application. Further, the flitch plates 34, 36 can be disposed adjacent to one or more sides of a corresponding main and/or side leg 24, 26. For example, according to certain embodiments, the main and side leg flitch plates 34, 36 can be positioned on opposing front and backsides of an associated main leg 24 or side leg 26. Additionally, each flitch plate 34, 36 can be oriented such that the flitch plate 34, 36 is parallel to the corresponding main or side leg 24, 26 to which the flitch plate 34, 36 is disposed along. The flitch plates 34, 36 can also be oriented such that opposing ends of the flitch plates 34, 36 at least partially overlap an adjacent portion of the top yoke 20 and the bottom yoke 22.

The core clamp 16 can be constructed to fix the transformer core 12 using the flitch plates 34, 36, such as, for example, to secure the transformer core 12 in a fixed arrangement using the flitch plates 34, 36. For example, the core clamp 16 can be constructed to secure the top yoke 20, bottom yoke 22, main leg(s) 24, and side leg(s) 26 (if any), in engagement with each other, as well as in a fixed arrangement. Additionally, the core clamp 16 can be configured to bear any stresses tending to distort the transformer core 12, or tending to displace some components (e.g., yokes 20, 22 and/or legs 24, 26) of transformer core 12 from other components (e.g., other yokes 20, 22 and/or legs 24, 26) of transformer core 12. Thus, the core clamp 16 can be constructed to withstand a variety of loads, such as, for example, loads or forces stemming from the weight of the transformer 10 and/or loads or forces generated by short circuit conditions, among other forces, loads and stresses.

As shown in at least FIG. 2, according to certain embodiments, the top clamp 30 of the core clamp 16 can include a front top clamp member 30A and a rear top clamp member 30B, while the bottom clamp 32 of the core clamp 16 can include a front bottom clamp member 32A and a rear bottom clamp member 32B. The top clamp 30 and the bottom clamp 32 can also be constructed to clamp the adjacent top and bottom ends, respectively, of the flitch plates 34, 36 to the adjacent portions of the transformer core 30, such as, for example, to the top yoke 20 and the bottom yoke 22. In this way, both ends of the main and side leg flitch plates 34, 36 can be fixed to the transformer core 12.

For example, the top ends of the main and side leg flitch plates 34, 36 can be positioned on either side of the transformer core 12, and can be clamped with other components of the transformer core 12 between at least the front top clamp member 30A and the rear top clamp member 30B of the top clamp 30 via use of clamp bolts or yoke bolts 28, including, for example, tie bolts, among other fastener means. Similarly, the bottom clamp 32 can be constructed to clamp at least the bottom ends of the main and side leg flitch plates 34, 36 between the front and rear bottom clamp members 32A-B (see FIG. 2). According to certain embodiments, such clamping of the top and bottom portions of the main and side leg flitch plates 34, 36 can include the main and side leg flitch plates 34, 36 the top and bottom portions of the main and side leg flitch plates 34, 36 being clamped against at least a portion of the adjacent top yoke 20 and bottom yoke 22, respectively.

According to certain embodiments, the flitch plates 34, 36 can have one or more slots in the flitch plates 34, 36. Such slots can provide areas within the flitch plates 34, 36 are partially or completely devoid of material. Moreover, according to certain embodiments, such slots can provide openings or cut-outs that extend completely through opposing sides of the flitch plates 34, 36, as well as the area therebetween. The number and configuration of such slots can vary for different flitch plates 34, 36, as well as for different types and sized transformers. For example, according to certain embodiments, the number and/or configuration of slots for the main leg flitch plates 34 can be different than the number and/or configuration of the slots for the side leg flitch plates 36. Additionally, according to certain embodiments, only some of the main leg flitch plates 34 and/or only some of the leg flitch plates 36 may include such slots. Additionally, according to certain embodiments, either the main leg flitch plates 34 or the side leg flitch plates 36 may contain slots.

Figures 3A, 3B, 3C, 3D:
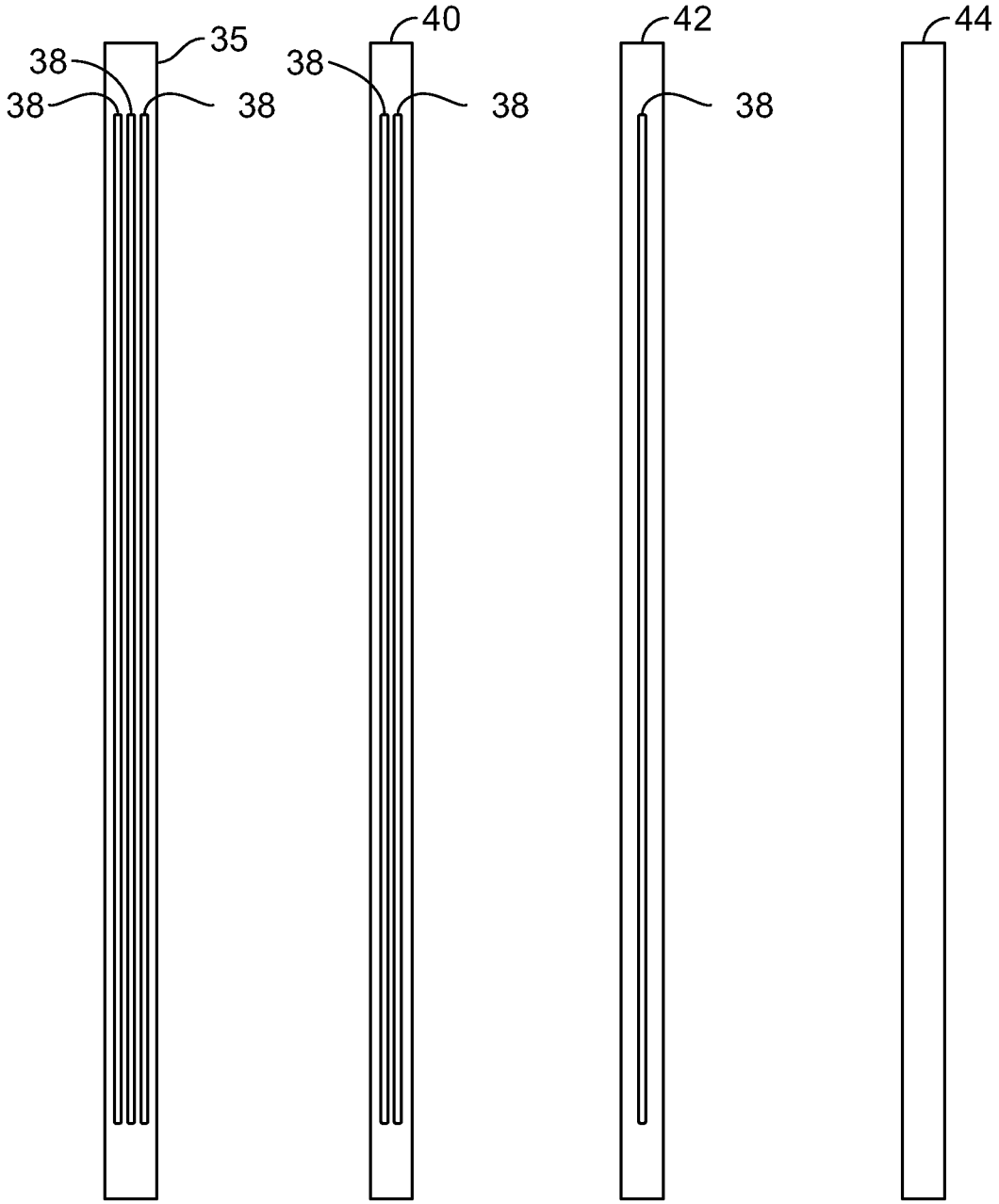
FIG. 3A-3D schematically illustrates some aspects of non-limiting examples of flitch plates that may be employed in accordance with some embodiments of the present invention.

For example, FIGS. 3A-3C illustrate non-limiting examples of flitch plates 35, 40, 42 that include one or more such slots 38 and which can be utilized for the previously discussed flitch plates 34, 36. More specifically, FIGS. 3A and 3B illustrate examples of flitch plates 35, 40 that can include a plurality of slots 38 that extend lengthwise or vertically along the flitch plate 35, 40, while FIG. 3C illustrates a flitch plate 42 having a single slot 38. While FIGS. 3A-3C illustrate flitch plates 35, 40, 42 that include three slots 38, two slots 38, and one slot 38, respectively, other embodiments 38 may include more slots 38. Alternatively, as shown in FIG. 3D, according to certain embodiments, the flitch plate 44 may not include any slot(s) 38. Further, such slots 38 can be formed, or produced, in the flitch plates 34, 36 in a variety of different manners, including, for example, via laser slotting and 3D printing, among other manners of forming or providing the slots 38 in the flitch plates 34, 36.

As shown in FIGS. 3A and 3B, with respect to at least certain embodiments in which the flitch plates 35, 40 have a plurality of slots 38, the slots 38 may, or may not, generally be parallel to the other slots 38 in the flitch plate 35, 40. Further, while FIGS. 3A and 3B illustrate each of the slots 38 as having generally uniform configurations and orientations, including vertical slots 38 having a length that terminates at locations that are approximately adjacent to each opposing end of the flitch plates 35, 40, according to certain embodiments, the shape, size, position, and/or orientation of at least one slot 38 can be different than that of at least one other slot 38 within the same flitch plate 35, 40, and/or with respect to one or more slots 38 in another flitch plate 35, 40.

The slots 38 can be configured in a manner that can at least assist in reducing eddy losses generated by windings 14. Moreover, the slots 38 can be configured such that the generated eddy loses are reduced to a level that facilitates a reduction in the peak temperature of the flitch plates 34, 36, also referred to as flitch plate peak temperature, to an acceptable level, as compared to a flitch plate having no slots 38, such as, for example the flitch plate 44 shown in FIG. 3D. Such eddy losses and peak temperatures can be determined, for example, by measurement and/or by finite element modeling using a commercially available numerical software package, e.g., 3D magnetic and thermal analysis.

An increase in the number of slots 38, such as, for example, to four or more slots 38, in the flitch plate 34, 36, can, in at least certain embodiments, further lower eddy losses and flitch plate peak temperatures. Conversely, fewer slots 38 can, according to at least certain embodiments, be employed, but at the expense of having higher eddy losses and higher peak temperatures in the flitch plate. For example, FIG. 3B illustrates a flitch plate 40 having two slots 38, which may, in at least certain circumstances, be sufficient to reduce eddy losses and achieve acceptable flitch plate peak temperatures. Such a degree of reduction in eddy losses and flitch plate peak temperatures may be less than that attained with the three slot 38 flitch plate 35 shown in FIG. 3A, such reductions in eddy losses and flitch plate peak temperatures still represent a substantial improvement over flitch plate configurations having a single slot 38 or no slots 38. Flitch plate 40 may thus be used in some embodiments as a main leg flitch plate in the embodiment of FIGS. 1 and 2.

Similarly, as previously mentioned, FIG. 3C illustrates a flitch plate 42 having a single slot 38, while the flitch plate 44 depicted in FIG. 3D has no slots 38. Although the single slot 38 flitch plate 42 shown in FIG. 3C has lower eddy losses and a corresponding lower peak flitch plate temperature than that of the flitch plate 44 having no slot 38, the eddy losses and concomitant temperature are nonetheless higher than for the multi-slot 38 flitch plates 35, 40 shown in FIGS. 3A and 3B. Accordingly, flitch plates 35, 40 having a plurality of slots, e.g., 2, 3 or more slots 38, may provide certain advantages with respect to at eddy losses and peak flitch plate temperatures. Further, with respect to at least certain embodiments, such benefits may result in use of flitch plates 35, 40 having a plurality of slots 38 being preferable, compared at least to flitch plates 42, 44 having one or no slots 38, with at least some, if not all, of the main legs 24 and/or side legs 26.

FIG. 4 illustrates a calculated flitch plate temperature rise versus the number of slots 38 in a flitch plate 34 for an exemplary three-phase, 432 MVA (mega volt-ampere) 230 kV (kilovolt) transformer. The depicted temperature rise in FIG. 4 is the increase in flitch plate maximum temperature resulting from eddy losses during operation of the transformer. As illustrated in FIG. 4, the temperature rise associated with flitch plates having a plurality of slots 38, e.g., two, three or four slots, is less than 20° C. (Celsius). Further, as shown, the maximum flitch plate temperature for flitch plates having a plurality of slots 38 is less than 105° C. during operation at 30° C. ambient temperature and 55° C. top oil temperature. However, for the flitch plate that has only a single slot 38, the temperature rise increases substantially, e.g., by approximately 50% or more, relative to at least embodiments having a plurality of slots 38, to approximately 30° C. Thus, the use of a plurality of slots 38 in a flitch plate provides a relatively substantial reduction in flitch plate temperature as compared to flitch plate having only a single slot 38.

FIG. 4 also illustrates values for a flitch plate having zero slots 38, including a 59.3° C. temperature rise, resulting in a maximum flitch plate temperature of 144.3° C., which exceeds a maximum admissible temperature of 140° C. for normal life expectancy loading for at least certain flitch plates. Additionally, as the flitch plate having no slots 38 may not exhibit any reduction in eddy losses or peak temperature, such a flitch plate may be undesirable and not suitable for use as a main leg flitch plate 24 in at least some embodiments. However, such a flitch plate having no slots 38, can according to certain embodiments, be suitable for use as a side leg flitch plate 26 that has no associated winding 14, where eddy losses may thus be naturally lower because of an increased distance from a winding 14, and thus may not generate undesirably high peak temperatures in the flitch plate.

As shown in at least FIG. 1, the top clamp 30 and/or bottom clamp 32 of the core clamp 16 can include one or more cutouts 50. Moreover, one or both of the front and rear top clamp members 30A-B, and/or one or both of the front and rear bottom clamp members 32A-B, of the top and bottom clamps 30, 32, respectively, can include one or more cutouts 50. According to certain embodiments, such cutouts 50 can represent features where a portion of clamp material having a predetermined shape is not present, as if that portion of material had been "cut out" from the top front and back clamp members 30A-B and/or in bottom front and back clamp members 32A-B. For example, the embodiment shown in FIG. 1 depicts exemplary cutouts 50 that are curved cutouts, e.g., curved arches, also referred to as scallops. Such cutouts 50 can, in various forms, be, or include, partial ellipses, such as, for example, a semi-ellipse or a quarter-ellipse, partial circles such as semi-circles or quarter circles, and/or other curved geometries. In the embodiment of FIG. 1, the cutouts 50 are, more particularly, semi-ellipses. Alternatively, or optionally, according to other embodiments, one or more of the cutouts 50 may include rectangular shaped cutouts and/or stepped arch (staircase) cutouts. However, according to certain embodiments, the clamps 30, 32 can have cutouts 50 of different shapes and sizes.

Figure 6A:
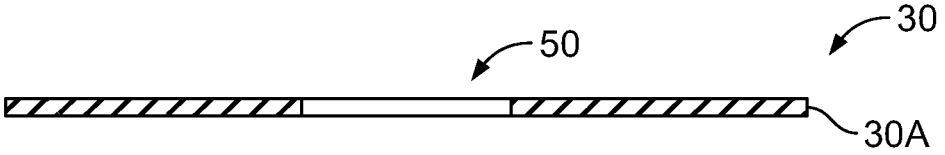
FIGS. 6A-6C schematically illustrate some aspects of non-limiting examples of core clamp member cross-section types in accordance with embodiments of the present invention.
Figure 6B:
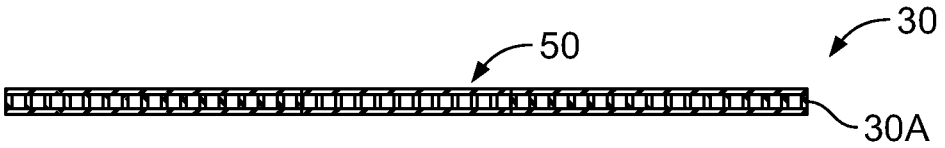
Figure 6C:
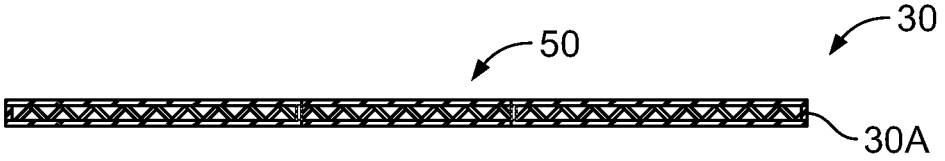

Additionally, according to certain embodiments, the cutouts 50 can be sized and positioned in the top and bottom clamps 30, 32 to expose a portion of the top yoke 20 and bottom yoke 22, respectively. Further, the cutouts 50 can be alternatively formed in one or more locations in top and/or bottom clamps 30, 32 having a cross-section in the form of an internal lattice structure, two examples of which are illustrated with top clamp members 30A in FIGS. 6B and 6C. In still other embodiments, front and rear top clamp members 30A-B, and/or the bottom front and rear clamp members 32A-B, can have generally C-channel or box channel cross-sectional shapes, among other cross-sectional shapes. Compared to generally solid clamps, such as, for example, the clamp 30 depicted in FIG. 6A, the inclusion of an internal lattice structure between opposing sides of the clamp 30, as shown for example in FIGS. 6B and 6C, can provide extra cooling exchange surfaces that can enhance the cooling of the top and/or bottom clamps 30, 32, and thereby result in a decrease in the operating temperatures of at least the top and/or bottom clamps 30, 32 during operation of the transformer 10. Such decreases in operating temperature of top and/or bottom clamps 30, 32 having an internal lattice structure can be further enhanced, and the operating temperature of generally solid clamps such as that depicted in FIG. 6A can also be reduced, by the inclusion of cutouts 50 that can be formed in the top and bottom clamps 30, 32, as is discussed below.

The cutouts 50 can be formed in the top and bottom clamps 30, 32 in a variety of manners. For example, according to some embodiments, the cutouts 50 can be formed by cutting material off, or from, the front and rear top clamp members 30A-B and the front and rear bottom clamp members 32A-B. According to other embodiments, the front and rear top clamp members 30A-B and/or the front and rear bottom clamp members 32A-B can be formed with cutouts 50 formed therein, including, but not limited to, via a 3D printing process.

Figure 5:
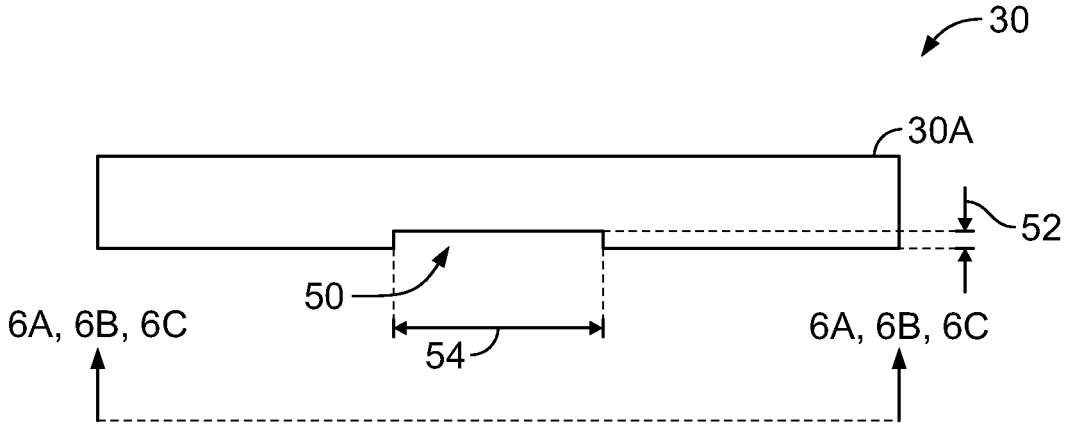
FIG. 5 schematically illustrates some aspects of a non-limiting example core clamp member having a cutout in accordance with an embodiment of the present invention.

Additionally, the top and bottom clamps 30, 32 can include one or more cutouts 50, regardless of the type of cross sectional shape of the top and bottom clamps 30, 32. Moreover, the front and rear top clamp members 30A-B and the front and rear bottom clamp members 32A-B can have a variety of cross-sectional shapes, including, but not limited to, cross sectional shapes that are associated with flat plates. Further, the cutouts 50 can each have a height 52 and a width 54, as shown for example by FIG. 5. For at least certain types of shapes, including, for example, non-rectangular shapes, profiles, or perimeters, the height 52 of the cutout 50 may refer to the maximum or peak height of the cutout 50. Additionally, the cutout 50 can be formed in one or more locations in front and rear top clamp members 30A-B and/or front and rear bottom clamp members 32A-B wherein front and rear top clamp members 30A-B and/or front and rear bottom clamp members 32A-B are in the form of flat plates with a solid cross-section (e.g., see front top clamp member 30A of FIG. 6A).

The cutouts 50 can be positioned and sized to reduce an attraction of stray flux from a winding 14 into the top clamp 30 and the bottom clamp 32, and, more specifically, into the front and rear top clamp members 30A-B and/or the front and rear bottom clamp members 32A-B. Such reduction in attraction of stray flux can reduce the operating temperature of top clamp 30 and bottom clamp 32. Additionally, in some embodiments, a reduction in the operating temperature of top clamp 30 and bottom clamp 32 can at least contribute to a reduction in the operating temperature of the flitch plates, and in particular, the main leg flitch plates 24. More specifically, reducing the maximum temperature of top clamp 30 and bottom clamp 32 can reduce the conduction of heat from top clamp 30 and bottom clamp 32 to the flitch plates.

While the cutouts 50 can be situated at a variety of locations along the top and/or bottom clamps 30, 32, according to certain embodiments, the cutouts 50 are positioned at locations about the top and/or bottom clamps 30, 32 that are most exposed to the leakage of flux coming out of the windings 14. Thus, according to at least certain embodiments, the attraction of stray flux into top clamp 30 and bottom clamp 32 can be reduced by positioning the cutouts 50 at a location in the top clamp 30 and/or bottom clamp 32 that is relatively close to the main core legs 24, and moreover, that is at or generally adjacent to the position of the active parts or windings 14. Moreover, in order to reduce the attraction of stray flux from winding 14 into top clamp 30 and bottom clamp 32, in some embodiments, the cutouts 50 are disposed at the locations where windings 14 are in relatively close proximity to top clamp 30 and bottom clamp 32, such as, for example, at or in general proximity to the intersections between the main legs 24 and the top and bottom yokes 20, 22. Additionally, or alternatively, according to certain embodiments, the cutouts 50 can be positioned, and extend to, at least at the ends of the top clamp 30 and/or bottom clamp 32, and moreover, at opposing ends of the top clamp 30 and/or bottom clamp 32, as shown, for example, by at least FIGS. 8A-9B.

The attraction of stray flux can also decrease with increasing height 52 of the cutout 50, as well as decrease with increasing a width 54 of cutout 50. Accordingly, the maximum operating temperature of top clamp 30 and bottom clamp 32 can also be reduced with increasing height 52 of cutouts 50, and with increasing width 54 of cutouts 50.

The actual shape, size, and position of the cutouts 50 can be based on a variety of different considerations, including, for example, being configured and/or positioned at locations that prevent the cutouts 50 from interfering with the placement of support features of the transformer 10. Thus, for example, referencing FIG. 1, the largest size of the cutout 50 for a particular top and bottom clamp 30, 32, can be based on the location of one or more bottom supports 58, top supports 60, and/or by yoke bolt supports 62, among other supports. According to certain embodiments, the bottom supports 58 and top supports 60 can, for example, be winding supports, including, but not limited to, foot supports or other supports constructed to provide support for windings 14. Other supports can include, for example, yoke bolt supports 62, which can, for example, support and accommodate yoke clamp bolts for clamping top and bottom yokes 20, 22 between respective front and rear top clamp members 30A-B and front and rear bottom clamp members 32A-B. Thus, for example, at least a portion of an outer perimeter of the cutouts 50 can bounded by, or otherwise disposed immediately adjacent to, the respective top and bottom supports 58, 60, and/or yoke bolt supports 62. Accordingly, with respect to the embodiment depicted in FIG. 1, the height of one or more of the cutouts 50 can by limited by the location of the adjacent respective top and bottom supports 58, 60, while the width 54 of the cutout 50 can be limited by the spacing between the adjacent yoke bolt supports 62. Further, as shown by FIG. 1, according to certain embodiments, successive yoke supports 62 can be spaced apart from each other by a distance that can accommodate the cutout 50 that is positioned therebetween having a width that is greater than the width of the adjacent main leg 24A, 24B, 24C. However, to the extent a support, including, for example, the above mentioned supports 58, 60, 62, is to be positioned within a region that is defined by the cutout 50, such supports can be constructed from a nonmagnetic material, including, for example, stainless steel.

While the above examples discuss the shape and size of the cutouts 50 being based, at least in part, on the location of various supports 58, 60, 62, the shape and configuration of the cutouts 50 can also be based, at least in part, on other considerations. For example, according to certain embodiments, the height 52 of the cutout 50, including, for example, the maximum height 50 for round or generally rounded cutouts 50, can correspond to a vertical location at which a maximum temperature is anticipated to be present in a similar top and/or bottom clamp 30, 32 that lacks any cutouts 50, and/or the position along the cutout 50 at which a maximum temperature would be anticipated to be located if the cutout 50 were not present. Such a location of the anticipated maximum temperature can be attained in a variety of different manners, including, for example, by finite element modeling of a similar top and/or bottom clamp 30, 32 having no cutouts 50 using a commercially available numerical software package, e.g., 3D magnetic and thermal analysis.

Alternatively, or additionally, the height 52, and/or the width 54, including maximum heights 52 and widths 54, of the cutout 50, can be based on anticipated or desired dielectric stress value, such as, for example, a predetermined value or limit for dielectric stress in the top clamp 30 and bottom clamp 32, and moreover, dielectric stress in a solid or liquid insulation that is positioned around the top and/or bottom clamps 30, 32, including, for example, mineral oil and/or cellulose or ester and/or cellulose based insulators, such as, but not limited to, paper and pressboard. Such a predetermined dielectric stress value can vary with the needs of the particular application or by location within the transformer system 10. For example, with respect to at least some embodiments or locations, the maximum allowable dielectric stress may be 11 kV/mm, whereas in others, the maximum allowable dielectric stress may be 6 kV/mm, or 2 kV/mm in other embodiments or locations. The predetermined dielectric stress value for various locations can be determined, for example, by measurement and/or by finite element modeling using an available numerical software package, e.g., 3D magnetic and thermal analysis, among other manners of determining the predetermined dielectric stress value.

As the dielectric stress can decrease with an increase in the height 52, and also decrease with an increase in the width 54, of the cutout 50, the shape of cutout 50, i.e., the profile, can be selected to achieve the predetermined dielectric stress value, and/or to reduce dielectric stress to or below a predetermined dielectric stress value. Accordingly, at least certain parameters relating to the shape or profile of the cutout 50, such as, for example, height, radius, and/or width, among other parameters, can be selected to satisfy a predetermined dielectric stress value in the associated component(s), such as, for example, the top clamp 30 and/or bottom clamp 32.

In view of the foregoing, according to certain embodiments, the location, size, and/or shape of the cutouts 50 can be based, at least in part, on at least one, if not all, of the following: thermal calculation, minimum dielectric distances, and mechanical constraints, including, but not limited to, the location of supports 58, 60, 62 and/or the mechanical limitations of the top and bottom clamps 30, 32. Moreover, according to certain embodiments, the configuration of the cutouts 50, and thus associated form of the associated top and/or bottom clamps 30, 32, can be dictated by: thermal calculation, such as, for example, the maximum core clamp calculated temperature being less than the admissible limit); minimum dielectric distances, such as, for example, the distance from the core clamps 16, which can be connected to ground, and windings 14 or cable with maximum voltage, which are to be higher than a predetermined dielectric value; and/or mechanical constraints, which can include the core clamps 16 being configured to support the transformer active part weigh and the short-circuit forces, axial forces, and/or radial forces, location of supports 58, 60, 62, and/or the number of main and side legs 24, 26 of the transformer core 12, among other constraints.

Figure 7B:
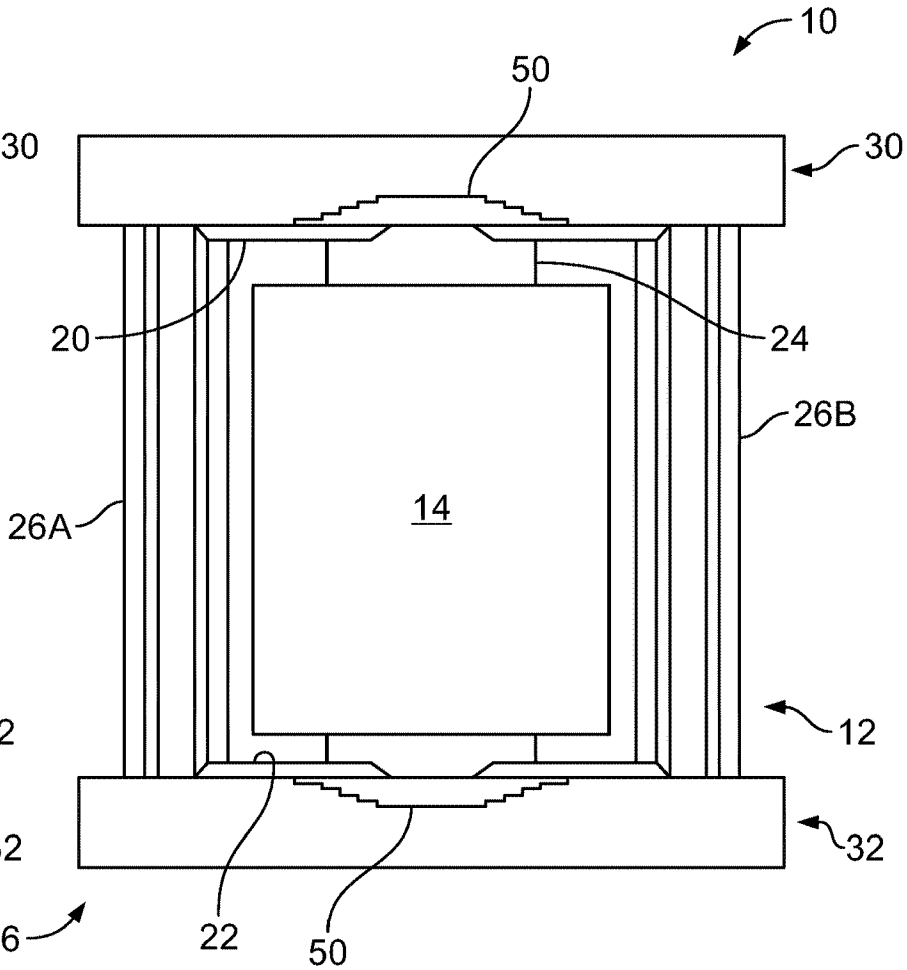
FIGS. 7A and 7B schematically illustrate some aspects of non-limiting examples of single-phase EY core transformers in accordance with embodiments of the present invention.
Figure 7A:
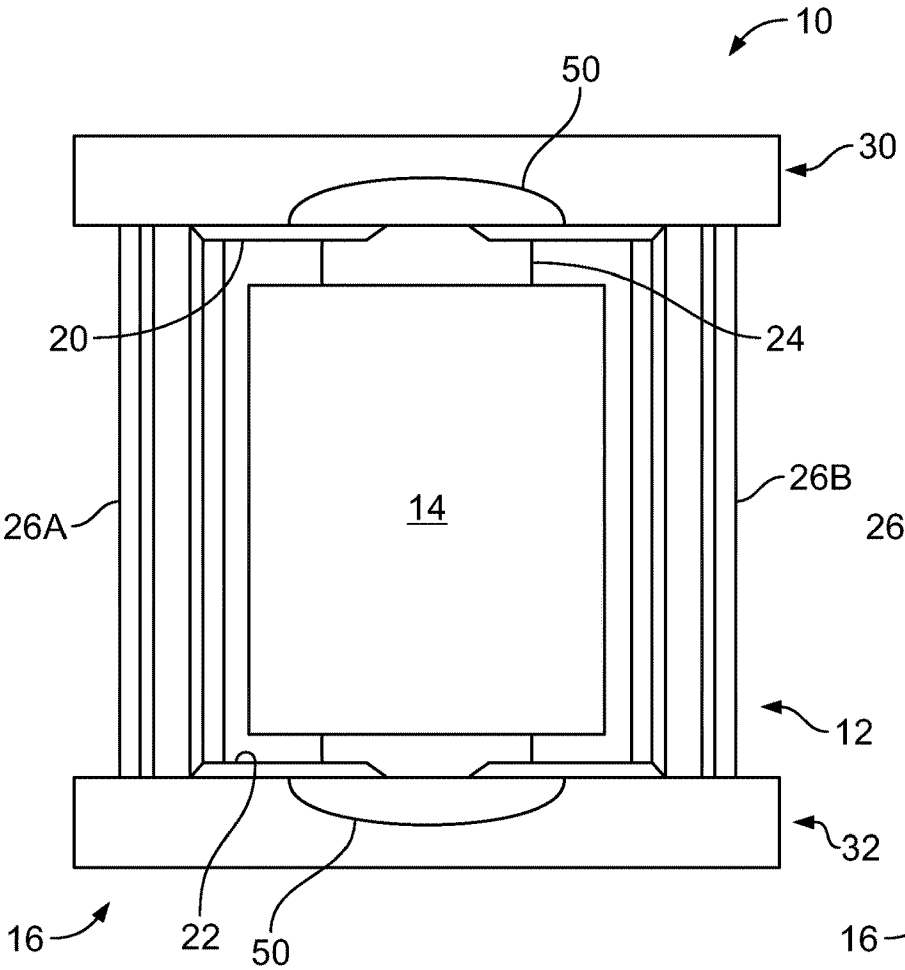
Figure 8A:
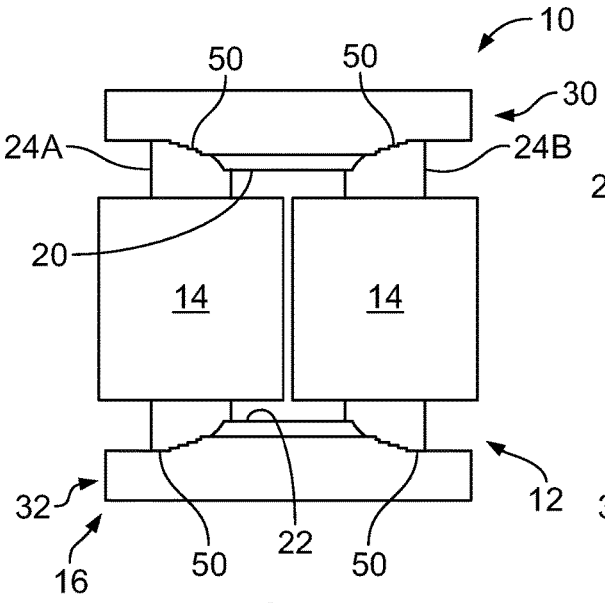
FIGS. 8A and 8B schematically illustrate some aspects of non-limiting examples of single-phase D core transformers in accordance with embodiments of the present invention.
Figure 8B:
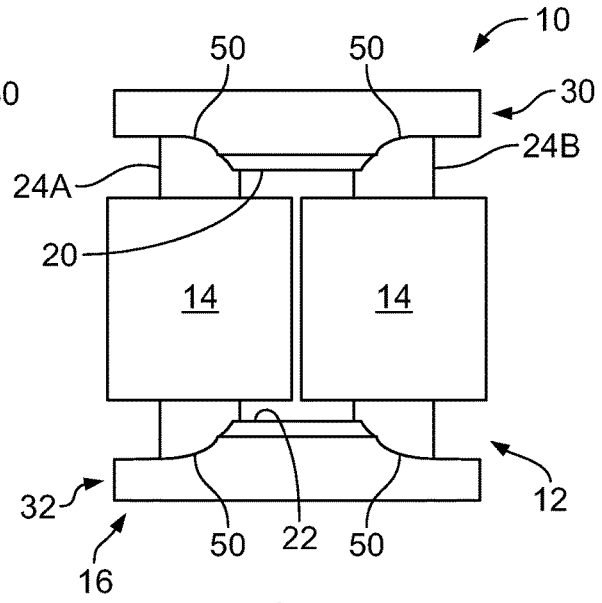
Figure 9A:
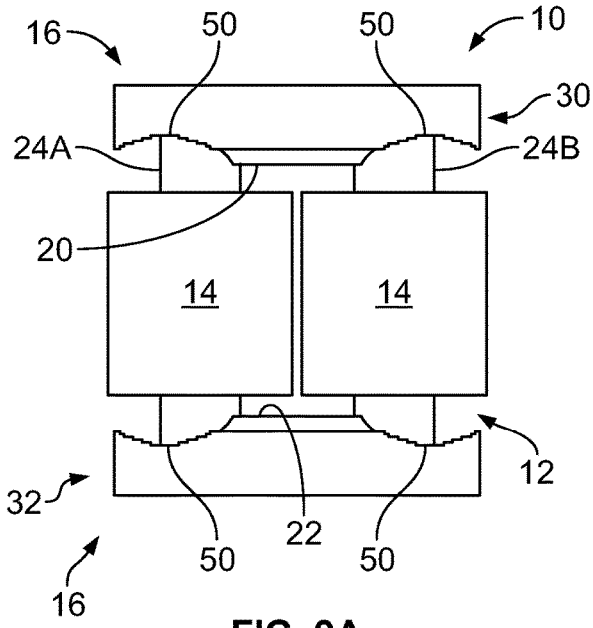
FIGS. 9A and 9B schematically illustrate some aspects of non-limiting examples of single-phase D core transformers in accordance with embodiments of the present invention.
Figure 9B:
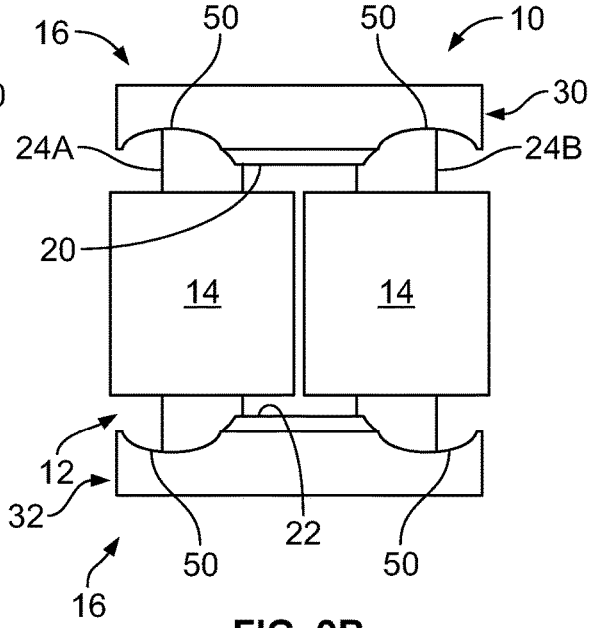

FIGS. 7A and 7B illustrate some aspects of non-limiting examples of a single-phase "EY core" transformer 10 in accordance with embodiments of the present application. The transformer core 12 shown in FIGS. 7A and 7B can include a single main leg 24, about which a winding 14 is disposed, and two side legs 26A, 26B. The core clamp 16 shown in FIG. 7A includes a cutout 50 having a curved arch shape, e.g., a semi-ellipse, whereas the core clamp 16 shown in FIG. 7B includes a cutout 50 having a stepped arch shape.

FIGS. 8A-9B illustrate some aspects of non-limiting examples of a single-phase "D core" transformer in accordance with embodiments of the present application. As shown, the transformer core 12 includes two main legs 24A, 24B, with a winding 14 disposed about each main leg, but does not include any side legs, such as the side legs 26 shown in FIG. 1. As shown, according to certain embodiments, the cutouts 50 can be positioned at, and extend to, opposing ends of the top and bottom clamps 30, 32. Further, according to certain embodiments, such cutouts 50 can have a generally rectangular configuration, such as, for example, a configuration in which the width 54 is larger than the height 52 of the cutout 50. However, according to certain embodiments in which such a rectangular configuration of the cutouts 50 in the top and/or bottom clamps 30, 32 is not mechanically feasible, then the cutout 50 can have a different configuration. For example, the cutouts 50 in the core clamp 16 of the embodiment shown in FIG. 8A each include a one-half stepped arch shape, while the cutouts 50 in the embodiment depicted in FIG. 8B each have a half curved arch shape, e.g., a quarter-ellipse shape. With respect to the embodiment depicted in FIG. 9A the cutouts 50 each have a stepped arch shape, while the cutouts 50 shown in FIG. 9B includes cutouts 50 each have a curved arch shape, e.g., a semi-ellipse shape.

Figure 10A:
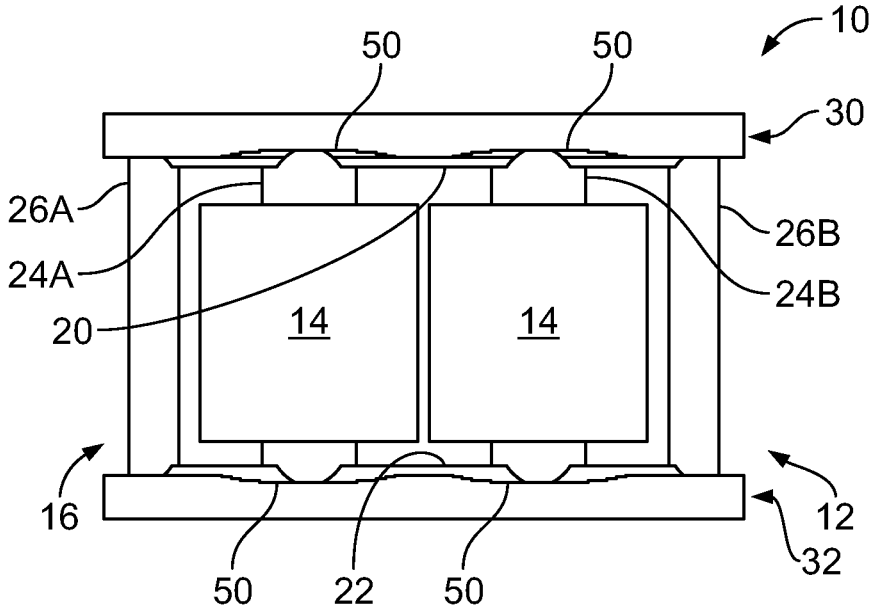
FIGS. 10A and 10B schematically illustrate some aspects of non-limiting examples of single-phase DY core transformers in accordance with embodiments of the present invention.
Figure 10B:
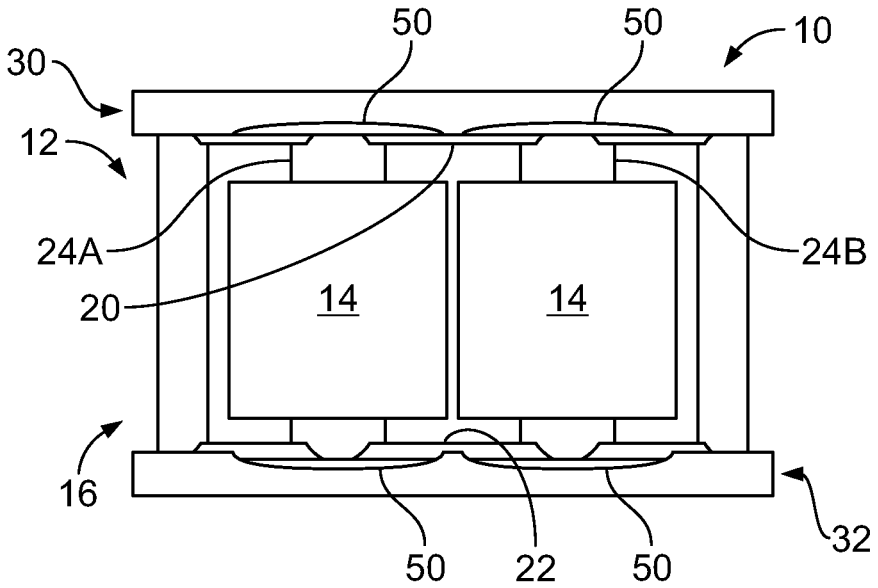
Figure 11B:
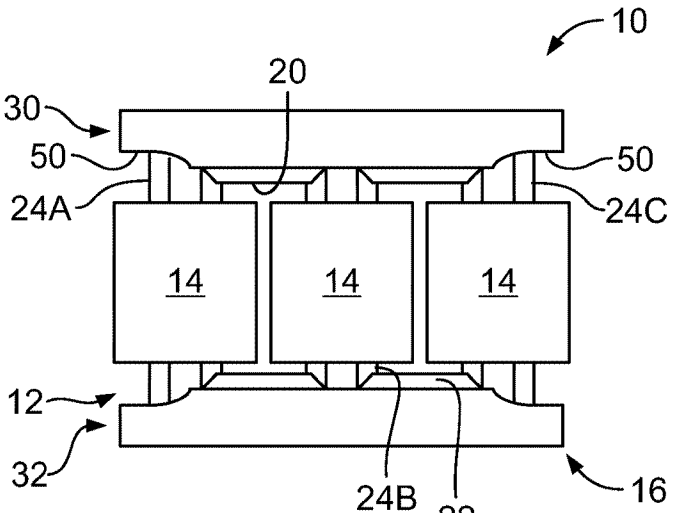
FIGS. 11A and 11B schematically illustrate some aspects of non-limiting examples of three-phase T core transformers in accordance with embodiments of the present invention.
Figure 11A:
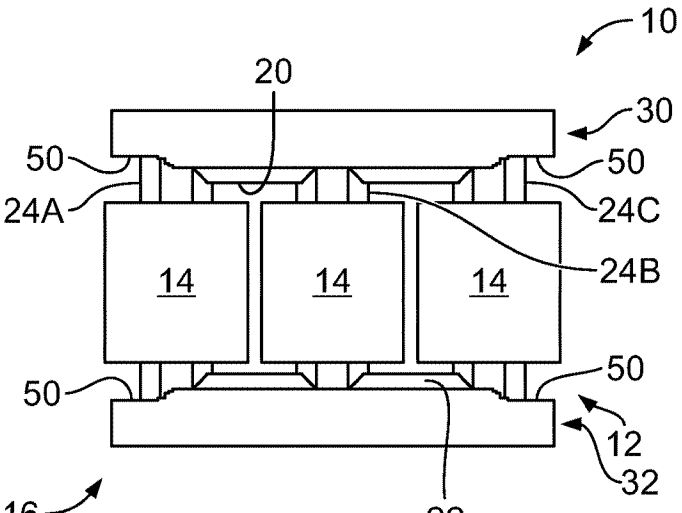
Figure 12B:
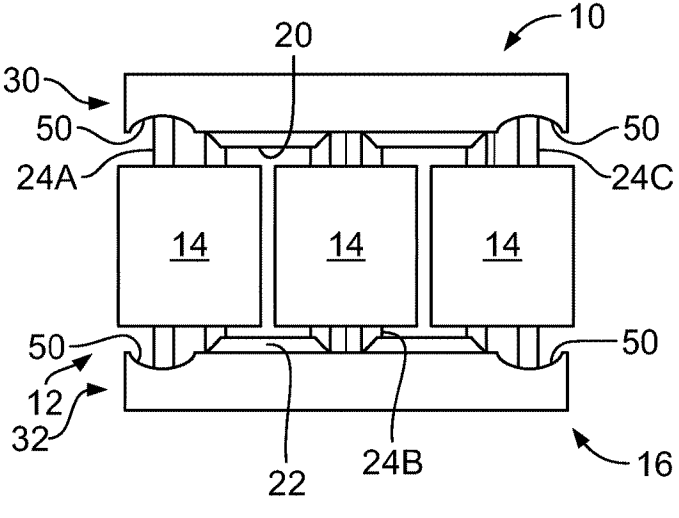
FIGS. 12A and 12B schematically illustrate some aspects of non-limiting examples of three-phase T core transformers in accordance with embodiments of the present invention.
Figure 12A:
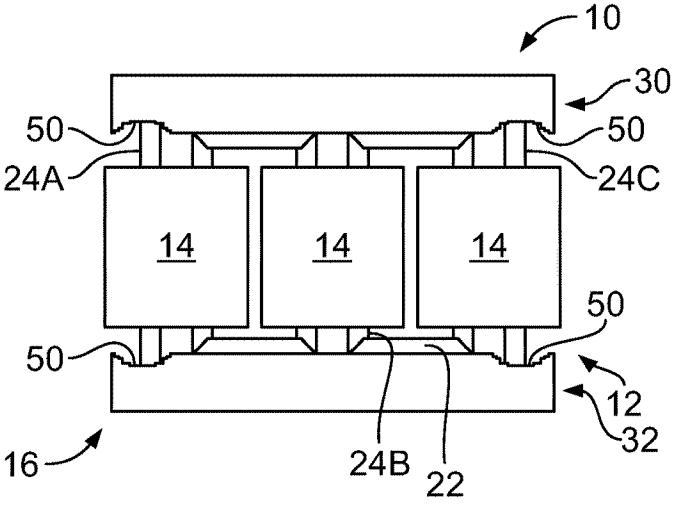

Referring to FIGS. 10A and 10B, some aspects of non-limiting examples of a single-phase "DY core" transformer in accordance with embodiments of the present invention are illustrated. In the embodiments of FIGS. 10A and 10B, the transformer core 12 includes two main legs 24A, 24B, with a winding 14 disposed about each main leg 24A, 24B, and two side legs 26A, 26B. The core clamp 16 of the embodiment of FIG. 10A includes cutouts 50 having a stepped arch shape, while the core clamp 16 of the embodiment of FIG. 10B includes cutouts 50 having a curved arch shape, e.g., a semi-ellipse shape.

FIGS. 11A-12B illustrate some aspects of non-limiting examples of a three-phase "T core" transformer in accordance with embodiments of the present application. In the embodiments of FIGS. 11A-12B, the transformer core 12 includes three main legs 24A, 24B, 24C with a winding 14 disposed about each main leg 24A, 24B, 24C, and does not include any side legs. The core clamp 16 shown in FIG. 11A includes cutouts 50 having a half-stepped arch shape, while the cutouts 50 depicted in FIG. 11B have a half curved arch shape, e.g., a quarter-ellipse shape. Further, the core clamp 16 shown in FIG. 12A includes cutouts 50 having a stepped arch shape, while the cutouts 50 shown in FIG. 12B have a curved arch shape, e.g., a semi-ellipse shape.

Figure 13:
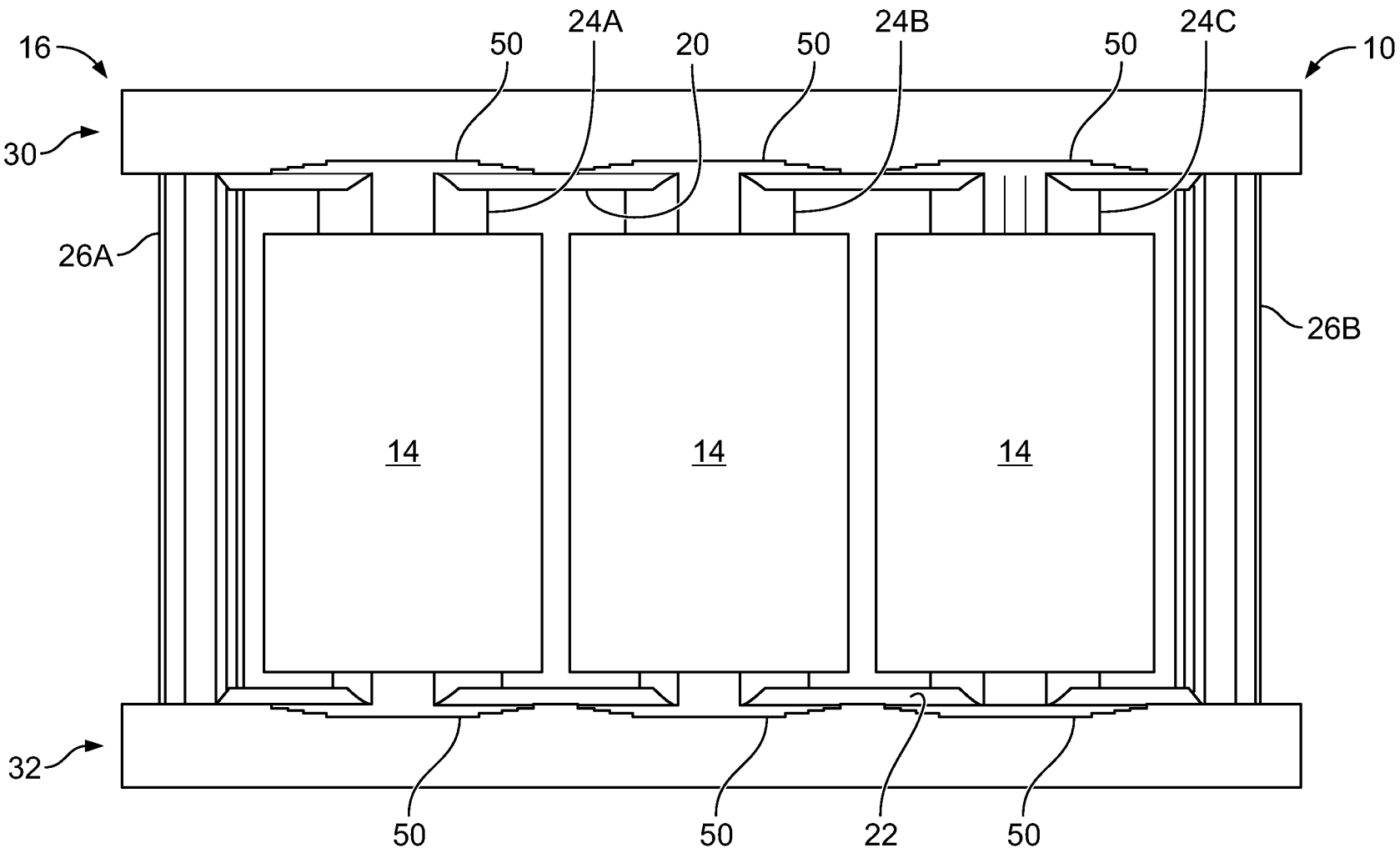
FIG. 13 schematically illustrates some aspects of a non-limiting example of a "TY core" transformer in accordance with an embodiment of the present invention.

FIG. 13 illustrates some aspects of a non-limiting example of a three-phase "TY core" transformer 10. The embodiment of FIG. 13 is the same as the embodiment of FIG. 1, with the exception that the cutouts 50 in the embodiment of FIG. 13 are stepped arches, whereas the cutouts 50 of the embodiment of FIG. 1 are curved arches in the form of semi-ellipses.

Similar to the transformer 10 shown in FIG. 1, the transformers 10 shown in FIGS. 7A-13 can each include main leg flitch plates 34 having one or more slots 38 therein, and, with respect to the embodiments depicted in FIGS. 7A, 7B, 10A, 10B, and 13, one or more side leg flitch plates 36. Additionally, similar to the transformer 10 shown in FIG. 1, the cutouts 50 shown in FIGS. 7A-13 can each be bounded by supports 58, 60 (not shown), such as winding supports, and/or yoke bolt supports 62 (not shown). Additionally, or alternatively, the cutouts 50 in the top and bottom clamps 30, 32 in the embodiments of 7A-13 can have a height 52, including, for example, a maximum height, and width 54, among other profile shapes, that is/are based on a maximum operating temperature in similar clamps that do not cutouts 50. As previously discussed, such sizes for the cutouts 50 can, for example, be determined by analytical calculation. Further, according to certain embodiments, the size and/or shape of the cutouts 50 for the transformers 10 shown in 7A-13 can be based, at least in part, on a predetermined dielectric stress value, as also discussed above.

FIG. 14 is a table illustrating non-limiting examples of calculated core clamp temperature rise for some embodiments of the present invention vs. calculated core clamp temperature rise for some corresponding traditional core clamps. As seen with respect to the solid bottom clamps 32, the inclusion of the cutouts 50 can for some transformer core types result in a maximum temperature rise over the oil being less than 60% of than the maximum temperature rise that is experienced with traditional bottom clamps 32 that do not have cutouts 50. Similarly, the inclusion of the cutouts 50 in solid top clamp 30 can for some transformer core types result in a maximum temperature rise over the oil that is around 50%-75% lower than the maximum temperature rise that is experienced with traditional top clamps 30 that do not have cutouts 50. While FIG. 14 provides exemplary data with respect to solid top and bottom clamps 30, 32 that include cutouts 50, the top and bottom clamps 30, 32 having both cutouts 50 and an internal lattice structure, such as that depicted in FIG. 6B or FIG. 6C, can result in an approximately 30% further reduction in the maximum temperature rise.

Such reductions in the maximum temperature rise over the oil can provide a number of benefits for transformers 10 having top clamps 30 and/or bottom clamps 32 that have cutouts 50. For example, with respect to at least transformers 10 in which the distance between the top yoke 20 and the bottom yoke 22 is dictated by heating, such as, for example stray flux in the core clamps that is exposed to magnetic fields (e.g. magnetic distance), such a reduction in temperature rise can result in a decrease in the distance between the top and bottom yokes 20, 22, and thereby reduce the core steel mass, transformer tank height drop, volume of oil in the transformer tank, and the distance from the winding 14 to the top and bottom yokes 20, 22. Further, with respect to at least transformers 10 in which the distance between the top yoke 20 and the bottom yoke 22 is dictated by dielectric stress (e.g. dielectric distances), such as dielectric constraints associated with assuring minimum dielectric distance between max potential (high voltage windings) and ground (which can be provided by a ground connection of the core 12 and/or core clamp 16), such a reduction in temperature rise can result in a decrease in the temperature of the core clamp 16.

While the invention has been described in connection with what is presently considered to be the most practical and preferred embodiment, it is to be understood that the invention is not to be limited to the disclosed embodiment(s), but on the contrary, is intended to cover various modifications and equivalent arrangements included within the spirit and scope of the appended claims, which scope is to be accorded the broadest interpretation so as to encompass all such modifications and equivalent structures as permitted under the law. Furthermore it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

The invention claimed is:

1. A transformer comprising:

a transformer core having a top yoke, a bottom yoke, and a leg, the leg extending between the top yoke and the bottom yoke, the transformer core constructed to form a magnetic flux path between and through the top yoke, the leg, and the bottom yoke;

a winding disposed about the leg;

a flitch plate disposed adjacent to the leg and extending between the top yoke and the bottom yoke; and a core clamp having a top clamp and a bottom clamp, the flitch plate being clamped to the top yoke by the top clamp and clamped to the bottom yoke by the bottom clamp, the top clamp and the bottom clamp each including a cutout positioned and sized to reduce an attraction of stray flux from the winding into the corresponding top clamp and bottom clamp by the absence of material in the cutout, wherein the cutout of at least one of the top clamp and the bottom clamp has a maximum vertical height in a direction that is generally parallel to a direction the leg extends between the top yoke and the bottom yoke that is selected to achieve a predetermined dielectric stress value in an insulation positioned around the corresponding top clamp or bottom clamp.

2. The transformer of claim 1, wherein the top clamp and the bottom clamp include an internal lattice structure.

3. The transformer of claim 1, wherein the flitch plate includes at least one slot that extends through the flitch plate and which is positioned along at least a portion of the flitch plate between the top yoke and the bottom yoke, the at least one slot being configured to at least assist in reducing eddy losses generated by the winding by changing the attraction of stray flux from the winding by the absence of material in the at least one slot.

4. The transformer of claim 3, wherein the at least one slot extends longitudinally in a direction that is generally parallel to a direction that the leg extends between the top yoke and the bottom yoke.

5. The transformer of claim 1, wherein the cutout in the top clamp is disposed at an intersection between the leg and the top yoke.

6. The transformer of claim 1, wherein the cutout in the bottom clamp is disposed at an intersection between the leg and the bottom yoke.

7. The transformer of claim 1, wherein the cutout of at least one of the top clamp and the bottom clamp has a width in a direction that is generally perpendicular to a direction that the leg extends between the top yoke and the bottom yoke that is greater than a width of the leg, the width of the cutout being generally parallel to the width of the leg.

8. The transformer of claim 1, wherein the cutout in at least one of the top clamp and the bottom clamp has a maximum height in a direction that is generally parallel to a direction the leg extends between the top yoke and the bottom yoke that corresponds to a vertical location of a highest operating temperature in another similarly shaped top or bottom clamp that does not have the cutout.

9. The transformer of claim 1, wherein the cutout has a rounded arch configuration.

10. The transformer of claim 1, wherein the cutout in at least one of the top clamp and the bottom-clamp is bounded by at least one of a winding support for the winding and a yoke bolt in the corresponding top clamp or bottom clamp.

11. A transformer comprising:

a transformer core having a top yoke, a bottom yoke, and legs, the legs extending between the top yoke and the bottom yoke, the transformer core constructed to form a magnetic flux path between and through the top yoke, the legs, and the bottom yoke;

windings disposed about the legs;

flitch plates disposed adjacent to the legs and extending between the top yoke and the bottom yoke, each flitch plate of the flitch plates having at least one slot that extends through the flitch plate and which is positioned along at least a portion of the flitch plate between the top yoke and the bottom yoke, the at least one slot being configured to at least assist in reducing eddy losses generated by the winding by changing an attraction of stray flux from the winding by the absence of material in the at least one slot; and core clamps having top clamps and a bottom clamps, the flitch plates being clamped to the top yoke by the top clamps and clamped to the bottom yoke by the bottom clamps.

12. The transformer of claim 11, wherein at least one of the top clamps and the bottom clamps include cutouts positioned and sized to reduce an attraction of stray flux from the windings into the corresponding at least one of the top clamps and the bottom clamps.

13. The transformer of claim 12, wherein the at least one slot comprises a plurality of slots, and wherein the plurality of slots extends longitudinally in a direction that is generally parallel to a direction that the legs extend between the top yoke and the bottom yoke.

14. The transformer of claim 13, wherein the top clamps and the bottom clamps include an internal lattice structure.

15. A transformer comprising:

a transformer core having a top yoke, a bottom yoke, and legs, the legs extending between the top yoke and the bottom yoke, the transformer core constructed to form a magnetic flux path between and through the top yoke, the leg and the bottom yoke;

windings disposed about the legs;

flitch plates disposed adjacent to the legs and extending between the top yoke and the bottom yoke, each flitch plate of the flitch plates having at least one slot that extends through the flitch plate and which is positioned along at least a portion of the flitch plate between the top yoke and the bottom yoke, the at least one slot being configured to at least assist in reducing eddy losses generated by the winding by changing an attraction of stray flux from the winding by the absence of material in the at least one slot; and core clamps having top clamps and a bottom clamps, the flitch plates being clamped to the top yoke by the top clamps and clamped to the bottom yoke by the bottom clamps, the top clamps and the bottom clamps each including a cutout positioned and sized to reduce an attraction of stray flux from the winding into the corresponding top clamp and bottom clamp by the absence of material in the cutout, and wherein at least one of the top clamps and the bottom clamps include an internal lattice structure.

16. The transformer of claim 15, wherein the at least one slot comprises a plurality of slots, and wherein the plurality of slots extends longitudinally in a direction that is generally parallel to a direction that the leg extends between the top yoke and the bottom yoke.

17. The transformer of claim 15, wherein top clamps and the bottom clamps each include at least one cutout, at least one of the at least one cutout in the top clamp being disposed at an intersection between the leg and the top yoke, and at least one of the at least one cutout in the bottom clamp being disposed at an intersection between the leg and the bottom yoke.

18. The transformer of claim 11, wherein at least one of the top clamps and the bottom clamps include cutouts comprising at least one of a rectangular configuration, a stepped configuration, or a rounded arch configuration.

19. The transformer of claim 11, wherein at least one of a size, a shape, a position, a number of slots, and an orientation of at least one of the flitch plates is different than at least one other flitch plate of the flitch plates.

* * * * *